US006208299B1

(12) United States Patent
Lindmark et al.

(10) Patent No.: US 6,208,299 B1
(45) Date of Patent: Mar. 27, 2001

(54) DUAL BAND ANTENNA ARRANGEMENT

(75) Inventors: Björn Lindmark, Stockholm; Stefan Jonsson, Stocksund; Dan Karlsson, Solna, all of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/525,521

(22) Filed: Mar. 15, 2000

(30) Foreign Application Priority Data

Mar. 15, 1999 (SE) ..... 9900914-4

(51) Int. Cl.[7] ..... H01Q 1/38
(52) U.S. Cl. ..... 343/700 MS
(58) Field of Search ..... 343/700 MS, 725, 343/729, 850, 852, 853; H01Q 1/38, 13/08, 21/24

(56) References Cited

U.S. PATENT DOCUMENTS

| | | | | |
|---|---|---|---|---|
| 4,429,311 | * | 1/1984 | Barewald | 343/725 |
| 4,691,206 | * | 9/1987 | Shapter et al. | 343/700 MS |
| 4,870,426 | | 9/1989 | Lamberty et al. | 343/727 |
| 5,534,877 | * | 7/1996 | Sorbello et al. | 343/700 MS |
| 5,831,581 | * | 11/1998 | Keough | 343/725 |
| 6,091,365 | * | 7/2000 | Derneryd et al. | 343/700 MS |

FOREIGN PATENT DOCUMENTS

| | | |
|---|---|---|
| 0433255A2 | 6/1991 | (EP) . |
| 2157500A | 10/1985 | (GB) . |
| WO99/31757 | 6/1999 | (WO) . |

* cited by examiner

*Primary Examiner*—Tho Phan
(74) *Attorney, Agent, or Firm*—Jacobson, Price, Holman & Stern, PLLC

(57) ABSTRACT

An antenna arrangement for receiving and/or transmitting electromagnetic signals in two spaced-apart frequency bands including a first frequency band having a first center frequency (f1) and a second frequency band having a second center frequency (f2). A first set of antenna elements (A1) are operative in the first frequency band (f1), and a second set of antenna elements (A2) are operative in the second frequency band (f2). A feeding network (C, 10, C1, C2) is arranged for feeding signals to the respective sets of antenna elements. The first set of antenna elements (A1) are arranged geometrically so that the first set has a first length (D1) in a first direction. The second set of antenna elements (A2) are arranged geometrically so that the second set has a second length (D2) in said first direction. In order to obtain lobes with the same beam width, said first and second lengths (D1, D2) are substantially inversely proportional to the first and second center frequencies (f1, f2).

14 Claims, 5 Drawing Sheets

Prior Art

DUAL BAND ANTENNA ARRANGEMENT

FIELD OF INVENTION

The present invention relates to an antenna arrangement for receiving and/or transmitting electromagnetic signals in at least two spaced-apart frequency bands, a first frequency band having a first centre frequency and a second frequency band having a second centre frequency, in particular a first centre frequency being substantially higher than said second centre frequency, comprising a first set of antenna elements being operative in said first frequency band, a second set of antenna elements being operative in said second frequency band, and a feeding network arranged for feeding signals, in said first and second frequency bands, to said first and second set of antenna elements, repectively.

PRIOR ART

Such an antenna arrangement is previously known from, e.g., EP 0 433 255 B1 (COMSAT), a first array of radiating elements (a first set of antenna elements) having a first size and a second array of radiating elements (a second set of antenna elements) having a second size being larger than said first size. The first array of radiating elements operates in a first frequency band which is at least 1 GHz higher than the second frequency band.

There is a first feeding layer with a power divider for feeding signals in the higher frequency band to the first array of antenna elements and a second feeding layer with a power divider for feeding signals in the lower frequency band to the second array of antenna elements. The power dividing elements in the two layers are designed so as to minimize the radiation interaction between the two arrays as well as the coupling between the two power distribution networks.

However, the antenna elements of the first and second arrays are located in corresponding positions in the respective layers of the multi-layer structure of the antenna arrangement. So, in each of the two dimensions of the generally planar structure, the two arrays have basically the same geometrical length (as measured between the outermost antenna elements). Let us assume that the antenna arrangement is substantially vertically oriented. Then, it will transmit a generally horizontal lobe of radiation, and the vertical beam width of the transmitted lobe will be approximately proportional to the wavelength of the radiation and inversely proportional to the total length of the respective array in the vertical dimension. Accordingly, since the vertical lengths are basically the same, the beam width of the radiation in the higher frequency band will be much smaller than the beam width in the lower frequency band. If the higher frequency (in the first band) is about twice the lower frequency (in the second band), the beam width of the high frequency lobe will be only half of that of the the low frequency lobe.

SUMMARY OF THE INVENTION

The principal object of the present invention is to provide an antenna arrangement, of the kind stated in the first paragraph above, wherein the structure is such that the two lobes of radiation in said first and second frequency bands have substantially the same beam width.

This object is achieved in that the antenna elements in the first set of antenna elements are arranged geometrically so that said first set has a first length in a first direction, the antenna elements in the second set of antenna elements are arranged geometrically so that said second set has a second length in said first direction, and said first and second lengths are substantially inversely proportional to said first and second centre frequencies In this way, the beam width of the radiation lobe associated with the first set of antenna elements will be basically the same as the beam width of the radiation lobe associated with the second set of antenna elements.

An antenna arrangement according to the invention can be implemented in many ways within the scope of the appended claims. Preferably, the antenna elements are patch elements which can be easily included in a multi-layer structure, as is well-known in the art.

The antenna elements in the first set can be located at positions being different from those of the antenna elements in the second set, as long as the geometrical lengths, measured in said first direction, are inversely proportional to the centre frequencies. However, even more conveniently, a subset of the antenna elements in the first (high-frequency) set may be located at substantially the same positions as those of the antenna elements in the second (low-frequency) set. This can be easily implemented with antenna elements in the form of patches disposed in different layers of a substantially planar structure.

The first and second sets of antenna elements may be arranged in a substantially regular array extended in at least one dimension corresponding to said first direction, e.g., in a linear, preferably vertical row or in a rectangular planar array.

Advantageously, there is only one feeding network for feeding the signals in said first and second frequency bands, a filter means being provided for separating one of said frequency bands. The filter means may include a band stop filter or a diplexer.

Alternatively, the antenna arrangement may include two such feeding networks for feeding dual polarized signals, so as to obtain diversity in double channels being mutually orthogonal to each other.

BRIEF DESCRIPTION OF THE DRAWINGS

These and other features and advantages of the present invention will appear from the detailed description below, reference being made to the accompanying drawings.

DETAILED DESCRIPTION OF PREFERRED EMBODIMENTS

Figure 1:
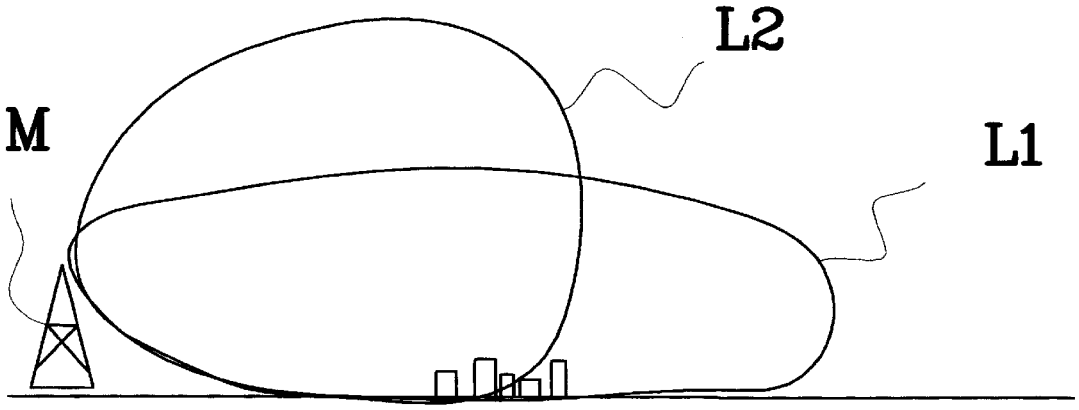
FIG. 1 illustrates a radiation pattern from a prior art antenna arrangement.

In FIG. 1, there is shown an antenna mast M with a conventional antenna arrangement of the kind disclosed in the above-mentioned EP publication. The antenna as such is not shown on the drawing, but only the radiation lobes transmitted from the antenna in two spaced-apart frequency bands, viz. a first lobe L1 in a relatively high frequency band and a second lobe L2 in a relatively low frequency band. As explained above, the lobe L1 in the upper band has a much smaller beam width than the lobe L2 in the lower band.

Figure 2:
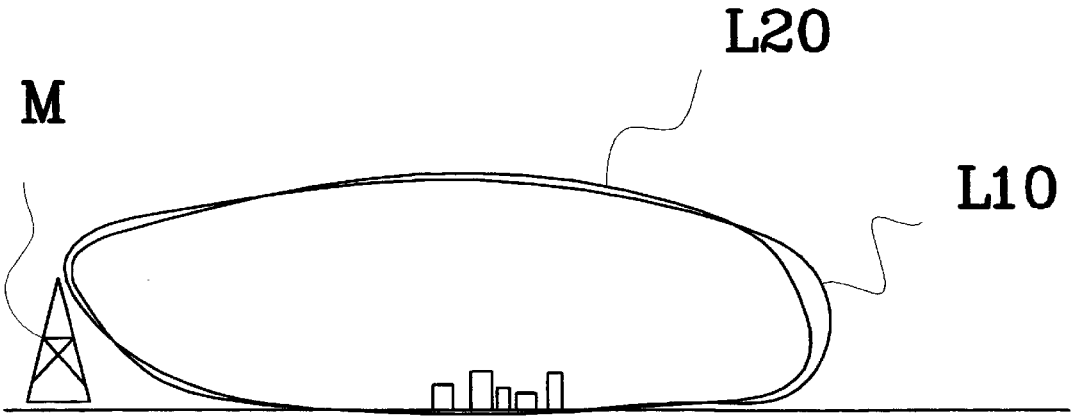
FIG. 2 illustrates, in a similar view, a radiation pattern from an antenna arrangement according to the present invention.

FIG. 2, on the other hand, shows in a similar manner an antenna mast M with an antenna arrangement according to the present invention. In this case, the two lobes L10 and L20 from the two spaced-apart frequency bands basically coincide with each other. Because of the particular vertical length of each set of antenna elements, being inversely proportional to the frequency, the beam widths of the two lobes L10, L20 are substantially the same. Accordingly, as desired, the coverage is virtually the same for both frequency bands.

Figure 3:
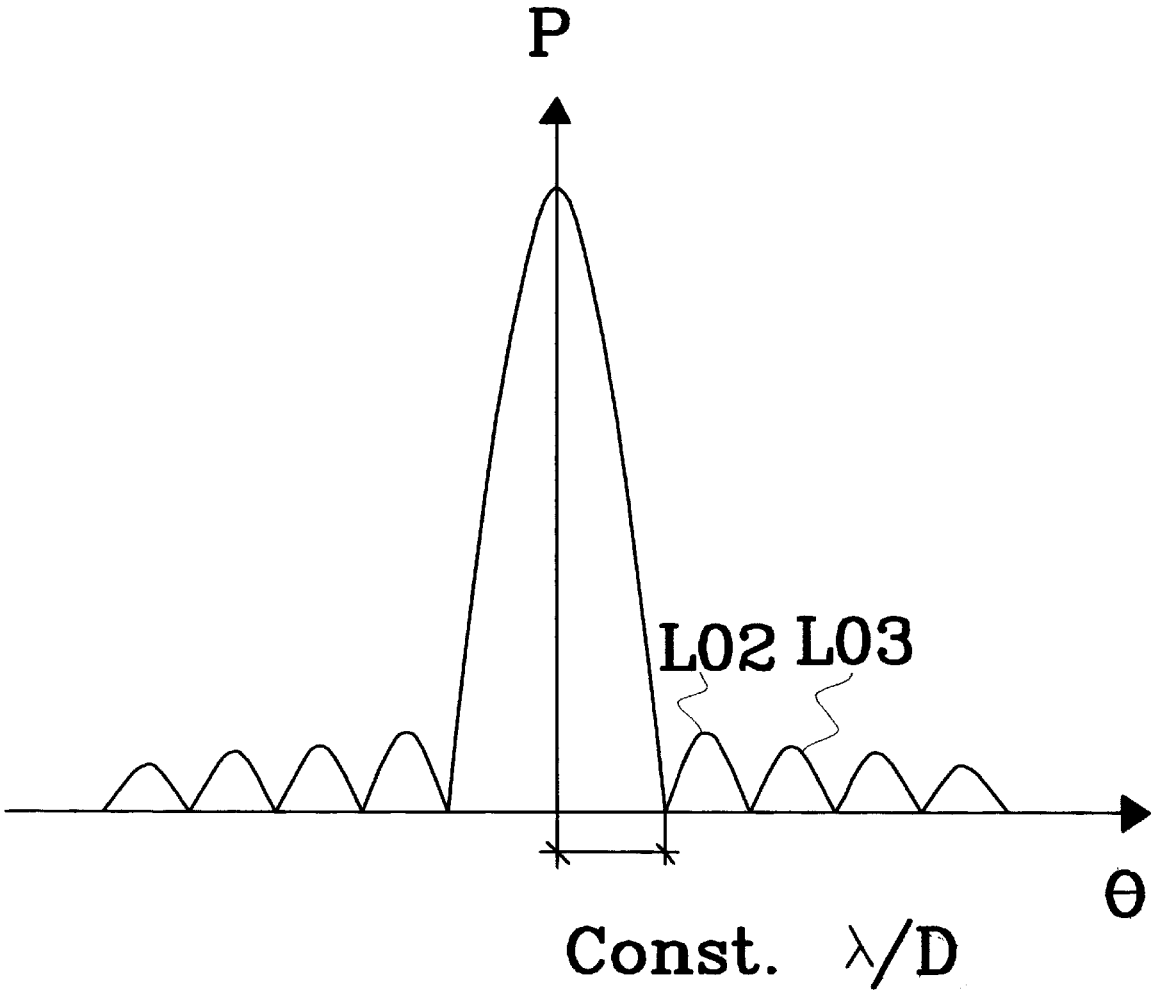
FIG. 3 shows schematically the radiated power from a vertically oriented antenna array.

FIG. 3 shows schematically how the transmitted power P from a linear antenna array with a length L (located along the vertical axis) is distributed as a function of the angle θ in the vertical plane (measured from a horisontal line). As can be concluded from FIG. 3, a primary lobe L01 is confined within a relatively narrow angular region, which can be shown to be proportional to the wavelength λ of the radiation (and thus inversely proportional to the frequency of the radiation) and inversely proportional to the length D of the linear array of antenna elements. Thus, the primary lobe L01 is limited by a first minimum at an angular value of (in radians):

$$\text{const. } \lambda/D$$

the constant being 1 in the ideal case of a uniform excitation along the linear array.

The secondary and higher order side lobes L02, L03, etc have substantially lower power values and can be ignored from a practical point of view.

The present invention is based on this physical relationship between the length of the linear array and the wavelength (or the frequency) of the radiated microwave power. In short, in order to obtain microwave lobes having substantially the same beam width, the linear array operating in a high frequency band (shorter wavelength) has a relatively short length D, whereas the linear array operating in a low frequency band (longer wavelength) has a relatively great length D. In other words, the lengths of the arrays are inversely proportional to the frequency.

Figure 4:
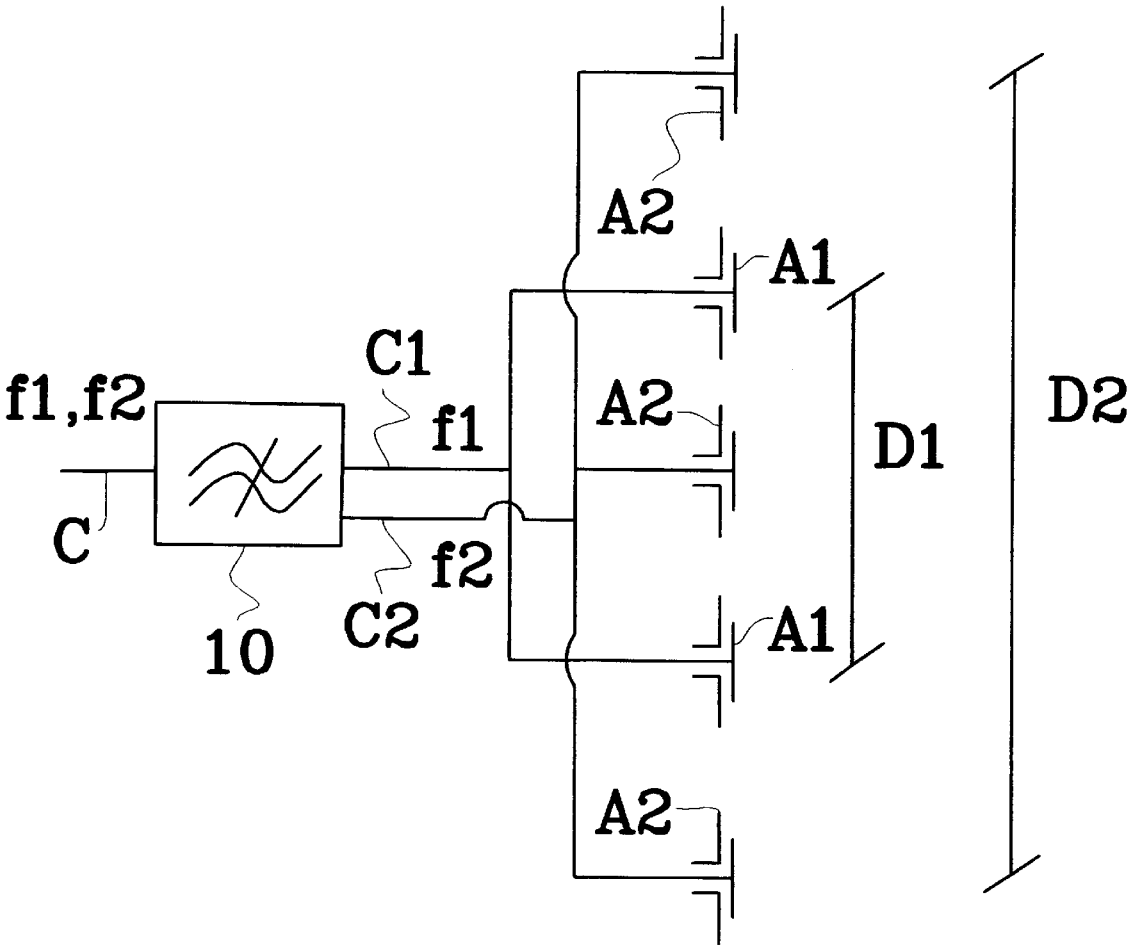
FIG. 4 shows schematically a first embodiment of the antenna arrangement according to the invention.

A first embodiment of the antenna arrangement is shown schematically in FIG. 4. A single feed cable C of a feeding network carries two spaced-apart frequency bands having centre frequencies f1 and f2, where f1 is e.g. 1800 MHz (PCN band) and f2 is, e.g., 900 MHz (GSM band). The feed cable C is connected to a diplex filter 10 having two outputs, one connected to a feed line C1 carrying only the higher frequency band with centre frequency f1 and the other connected to a feed line C2 carrying only the lower frequency band with centre frequency f2.

The feed line C1 is connected to two antenna elements A1, located at a distance D1 apart, the distance D1 also defining the length of the antenna array operating in the higher frequency band. The other feed line C2 is connected to three antenna elements A2. The length of the array including the antenna elements A2 is defined by the distance D2 between the top antenna element A2 and the bottom antenna element A2. In the illustrated example, D2 is about twice as long as D1, corresponding to the respective wavelengths (being inversely proportional to the frequencies f1,f2).

The antenna elements A1,A2 may be of any kind, e.g. in the form of, e.g., dipoles or patches. Of course, the mutual distance between adjacent antenna elements must be in agreement with established rules known to those skilled in the art.

Figure 5:
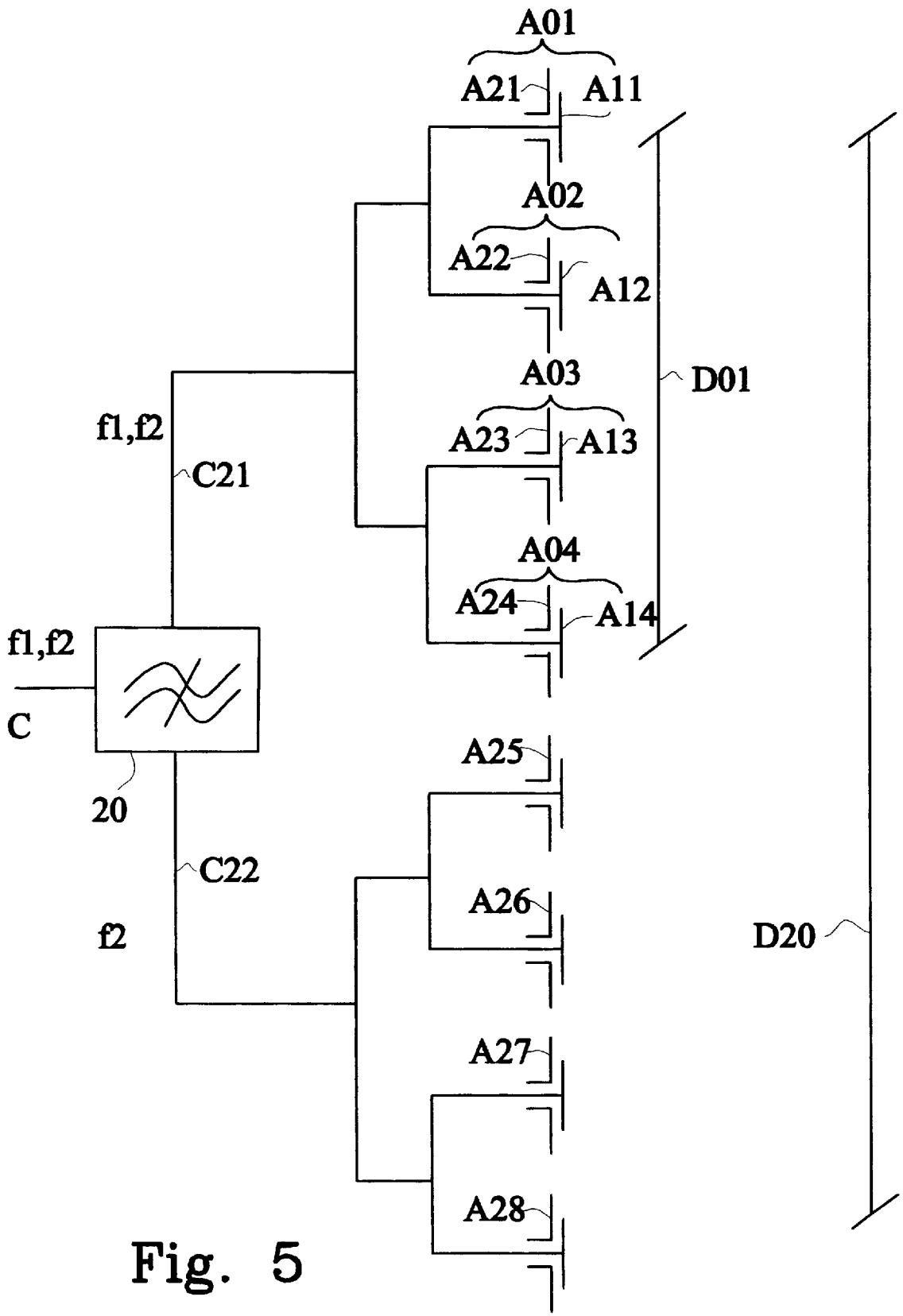
FIG. 5 shows schematically a second embodiment of the antenna arrangement according to the invention.

In FIG. 5, a second embodiment is shown, including a single feed cable C carrying two spaced-apart frequency bands, e.g. identical to the bands mentioned above with reference to FIG. 4, with centre frequencies f1 and f2, respectively, a filter 20, e.g. including a bandstop filter component in one output branch, and two feed lines C21 and C22 each connected to a group of antenna elements A01, A02, A03, A04 and A25, A26, A27, A28, respectively. The feed line C21 carries both frequency bands f1, f2 and feeds double elements A11–A21 (combination denoted A01), A12–A22 (combination denoted A02), A13–A23 (combination denoted A03) and A14–A24 (combination denoted A04). Each double element A11–A21, etc. includes a first antenna element A11, etc. being operative in the upper frequency band f1, and a second antenna element A21, etc. being operative in the lower frequency band f2. The length of the antenna array defined by the antenna elements A11, A12, A13, A14 being operative in the upper frequency band is D10, as indicated in FIG. 5.

The double antenna elements A11–A21, etc, may alternatively be replaced by unitary antenna elements being operative in both frequency bands.

The other feed line C22 carries, because of the structure of the filter 20, only the lower frequency band f2 and is connected to the group of antenna elements A25, A26, A27, A28 being operative in the lower frequency band. These antenna elements are located in line with the above-mentioned antenna elements A21, A22, A23, A24 so as to form together a linear row of eight antenna elements A21–A28 having a total length of D20. As can be seen from FIG. 5, the length D20 is about twice as long as the length D10 (corresponding to the respective wavelength).

For convenience of manufacture, the antenna elements A25, A26, A27, A28 may also be combined with smaller elements being operative in the upper frequency band, as shown in FIG. 5 (without reference numerals), but these smaller elements will remain passive since they are not fed with any power in the associated upper frequency band f1. Of course, these elements A25–A28 may also be replaced by unitary antenna elements being operative in both frequency bands (although used in only one frequency band).

As in the preceding embodiment, the antenna elements A11–A14 and A21–A28 may be of any appropriate kind. Most preferably, however, they are formed as patches in a multi-layer antenna structure, as is well-known to those skilled in the art.

As an obvious alternative, the combined or double antenna elements may be located in a central portion of the antenna arrangement, the single antenna elements then being located in the upper and lower portions thereof. It is important that the lengths D10 and D20 have the required relationship (proportional to the wavelengths and inversely proportional to the frequencies).

Figure 6:
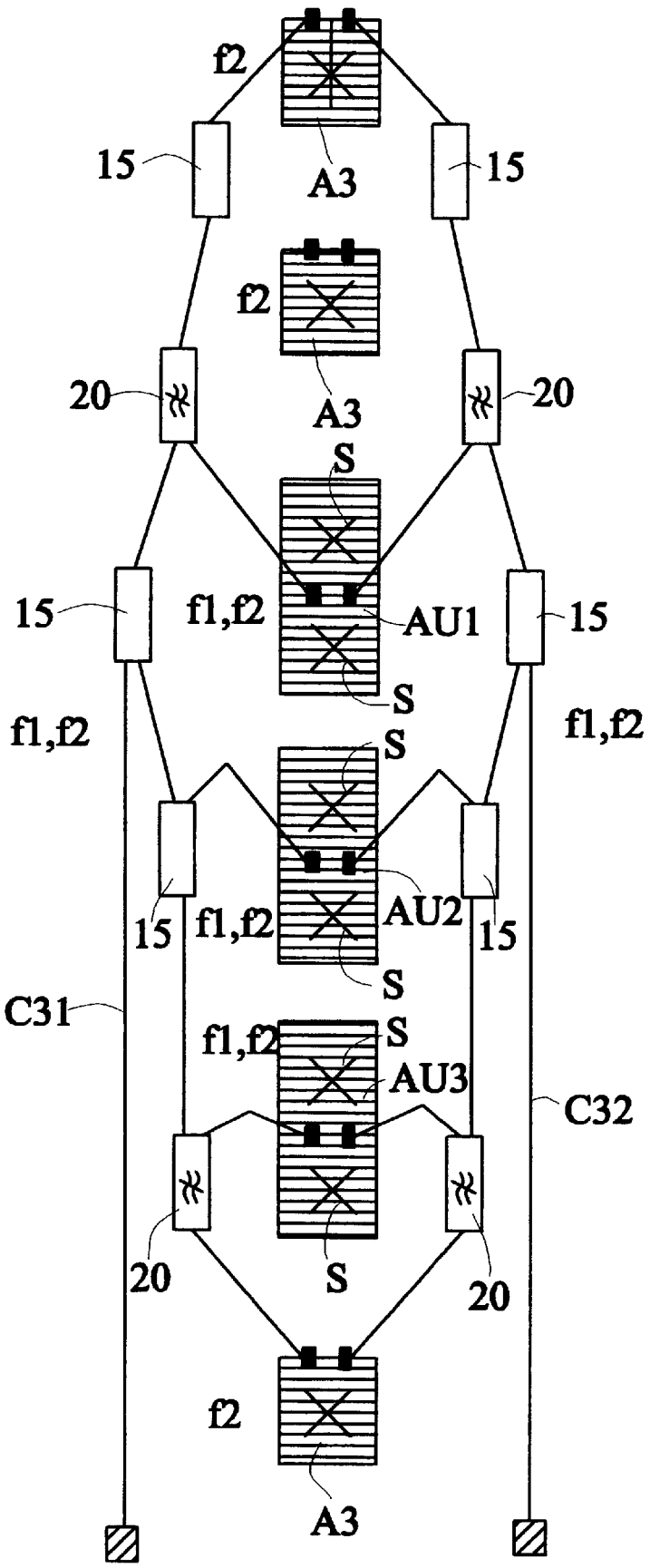
FIG. 6 shows schematically, in a planar view (as seen from the right in FIG. 5), a third embodiment with dual polarization.

A third embodiment of the antenna arrangement according to the invention is shown in FIG. 6, involving dual polarization. In this case, there are two feed cables C31 and C32, one for each polarization or channel, but each carrying both frequency bands f1, f2 (as explained above). These two frequency bands are fed to the various antenna units AU1, AU2, AU3 in the middle region of the antenna (the rectangular, elongated boxes with two crosses in each) via power dividers 15 and filters 20, e.g. of the same kind as in FIG. 5. These antenna units each include a pair of radiating patches being operative in the upper frequency band as well as a pair of somewhat larger radiating patches being operative in the lower frequency band. There is a relatively small patch and a relatively large patch positioned on top of each cross-shaped aperture or slot S, the latter serving to couple the microwave energy from a pair of feed elements (not shown, each connected to C31 and C32, respectively) to the patches. Such dual polarized, dual band antenna units are disclosed in e.g. the international application No. PCT/SE98/02235 (Allgon AB).

In the upper and lower end portions of the antenna arrangement, there are single antenna elements A3 being operative in the lower frequency band f2 only. In this way, there is formed a first, linear antenna array, including the six small patches of the antenna units AU1, AU2, AU3, having a length corresponding to about half of the total length of the antenna arrangement, and a second, linear antenna array, including the six larger patches of the antenna units AU1, AU2, AU3 and the three single antenna elements A3, having the same length as the whole antenna arrangement. Thus, also in this case, the length of the lower band antenna array is about twice as long as the length of the upper band antenna array.

In the three embodiments described above, the antenna elements are arranged in a single, vertical row. However, in general, the row may be oriented differently. Moreover, one such row may be combined with one or more parallel rows so as to form a regular (or irregular) two-dimensional array.

Of course, the particular frequency bands mentioned above are only given as examples. Other frequency bands may very well be used as long as the lengths of the antenna element rows are inversely proportional to the centre frequencies.

As indicated above, it is possible to use broad band antenna elements operable in at least two spaced-apart frequency bands What is clamed is:

1. Antenna arrangement for receiving and/or transmitting electromagnetic signals in at least two spaced-apart frequency bands including a first frequency band having a first centre frequency (f1) and a second frequency band having a second centre frequency (f2), comprising a first set of antenna elements (A1; A11–A14) being operative in said first frequency band (f1), a second set of antenna elements (A2; A21–A28) being operative in said second frequency band (f2), a feeding network arranged for feeding signals, in said first and second frequency bands, to said first and second set of antenna elements, respectively, characterized in that said antenna elements (A1; A11–A14) in said first set of antenna elements are arranged geometrically so that said first set has a first length (D1; D10) in a first direction, said antenna elements (A2; A21–A28) in said second set of antenna elements are arranged geometrically so that said second set has a second length (D2; D20) in said first direction, and said first and second lengths (D1, D2; D10, D20) are substantially inversely proportional to said first and second centre frequencies (f1, f2).

2. Antenna arrangement according to claim 1, wherein said antenna elements are patch elements.

3. Antenna arrangement according to claim 1, wherein the antenna elements (A1) in said first set are located at positions being different from those of the antenna elements (A2) in said second set.

4. Antenna arrangement according to claim 1, wherein a subset of the antenna elements (A21–A24) in said second set are located at substantially the same positions as those of the antenna elements (A11–A14) in said first set.

5. Antenna arrangement according to claim 4, wherein the antenna elements being located at substantially the same positions are combined into integrated antenna element units (A01, A02, . . . ; AU1, AU2, . . . ).

6. Antenna arrangement according to claim 1, wherein said first and second sets of antenna elements are arranged in a substantially regular array extended in at least one dimension, corresponding to said first direction.

7. Antenna arrangement according to claim 6, wherein said array comprises a linear row.

8. Antenna arrangement according to claim 7, wherein said linear row is substantially vertically oriented.

9. Antenna arrangement according to claim 1, wherein said first centre frequency (f1) is substantially twice said second centre frequency (f2).

10. Antenna arrangement according to claim 9, wherein said first frequency band corresponds to the PCN band and said second frequency band corresponds to the GSM band.

11. Antenna arrangement according to claim 1, wherein the antenna arrangement includes only one feeding network and filter means (10; 20) for separating one (f2) of said frequency bands.

12. Antenna arrangement according to claim 11, wherein the antenna arrangement includes two feeding networks, (C31, C32), for feeding dual polarised signals, each feeding network being connected to associated filter means (20).

13. Antenna arrangement according to claim 11, wherein said filter means (20) comprises at least one band stop filter.

14. Antenna arrangement according to claim 11, wherein said filter means (10) comprises at least one diplex filter.

* * * * *